US006702655B2

(12) United States Patent
Chen et al.

(10) Patent No.: US 6,702,655 B2
(45) Date of Patent: Mar. 9, 2004

(54) SLURRY DELIVERY SYSTEM FOR CHEMICAL MECHANICAL POLISHER

(75) Inventors: Wei-Train Chen, Hsinchu (TW); Wen-Tein Chen, Junghe (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 10/190,220

(22) Filed: Jul. 5, 2002

(65) Prior Publication Data

US 2004/0004090 A1 Jan. 8, 2004

(51) Int. Cl.[7] ..... B24C 7/00

(52) U.S. Cl. ..... 451/99; 451/36; 451/91; 451/288; 451/285

(58) Field of Search ..... 451/99, 41, 28, 451/36–40, 285–289, 91, 388; 137/487.5

(56) References Cited

U.S. PATENT DOCUMENTS 5,944,590 A * 8/1999 Isobe et al. ..... 451/288
6,126,830 A * 10/2000 Marshall ..... 210/627
6,283,840 B1 * 9/2001 Huey ..... 451/288
6,375,550 B1 * 4/2002 Berman ..... 451/41
6,447,381 B1 * 9/2002 Kubo ..... 451/288
2003/0098069 A1 * 5/2003 Sund et al. ..... 137/487.5

* cited by examiner

*Primary Examiner*—Lee D. Wilson
(74) *Attorney, Agent, or Firm*—Tung & Associates

(57) ABSTRACT

A slurry delivery system for a chemical mechanical polisher, comprising a bag housing fitted with a slurry intake conduit and a slurry outlet conduit. An expandible and collapsible pump bag is provided in fluid communication with the conduits inside the bag housing, and the interior of the pump bag is sealed from the bag housing. As an air/vacuum controller withdraws air from the housing, the pump bag enlarges and slurry is drawn into the pump bag. As the air/vacuum controller subsequently introduces air into the housing, the pump bag collapses and the slurry is expelled from the pump bag through the slurry outlet conduit. A purge valve is provided upstream of the pump bag to remove air bubbles from the slurry and vent the air to the atmosphere.

20 Claims, 3 Drawing Sheets

SLURRY DELIVERY SYSTEM FOR CHEMICAL MECHANICAL POLISHER

FIELD OF THE INVENTION

The present invention relates to chemical mechanical polishers used for polishing semiconductor wafers in the semiconductor fabrication industry. More particularly, the present invention relates to a new and improved slurry delivery system for delivering slurry to a chemical mechanical polisher for the polishing of semiconductor wafers.

BACKGROUND OF THE INVENTION

Apparatus for polishing thin, flat semiconductor wafers are well-known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head, a wafer unload station, or a wafer load station.

More recently, chemical-mechanical polishing (CMP) apparatus has been employed in combination with a pneumatically-actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in deionized water.

CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed separately. The chemical mechanical polishing method can be used to provide a planar surface on dielectric layers, on deep and shallow trenches that are filled with polysilicon or oxide, and on various metal films.

Referring next to FIG. 1, a conventional CMP apparatus 50 includes a conditioning head 52, a polishing pad 56, and a slurry delivery arm 54 positioned over the polishing pad. The conditioning head 52 is mounted on a conditioning arm 58 which is extended over the top of the polishing pad 56 for making a sweeping motion across the entire surface of the polishing pad 56. The slurry delivery arm 54 is equipped with slurry dispensing nozzles 62 which are used for dispensing a slurry solution on the top surface 60 of the polishing pad 56. Surface grooves 64 are further provided in the top surface 60 to facilitate even distribution of the slurry solution and to help entrapping undesirable particles that are generated by coagulated slurry solution or any other foreign particles which have fallen on top of the polishing pad 56 during a polishing process. The surface grooves 64, while serving an important function of distributing the slurry, also presents a processing problem when the pad surface 60 gradually wears out after prolonged use.

The slurry solution is typically distributed to the slurry dispensing nozzles 62 through tubing (not illustrated), by operation of a pump (not illustrated). The force generated by the pump forcing the slurry through the tubing tends to crack the tubing, and this causes premature drying of some of the slurry in the tubing and formation of particles in the tubing before the slurry is dispensed onto the wafer. These slurry particles tend to scratch the wafer during the CMP process. Additionally, air enters the slurry through the cracked tubing, forming air bubbles which tend to adversely affect the CMP operation.

Accordingly, a slurry delivery system is needed for removing particles and air bubbles from a CMP slurry as the slurry is transported from a slurry source to a CMP dispensing nozzle or nozzles.

An object of the present invention is to provide a slurry delivery system for delivering a polishing slurry to a slurry dispensing nozzle of a chemical mechanical polisher, wherein the slurry is devoid of air bubbles when dispensed onto a wafer for polishing.

Another object of the present invention is to provide a slurry delivery system for delivering a polishing slurry to a slurry dispensing nozzle of a chemical mechanical polisher, wherein the slurry is devoid of particles when dispensed onto a wafer for polishing.

Still another object of the present invention is to provide a slurry delivery system which is capable of removing air bubbles and particles from a polishing slurry before the slurry is deposited onto a semiconductor wafer for chemical mechanical polishing of the wafer.

Yet another object of the present invention is to provide a slurry delivery system which facilitates a substantial reduction in wafer scratching during chemical mechanical polishing of the wafer.

A still further object of the present invention is to provide a slurry delivery system which optimizes the performance of a chemical mechanical polisher in the polishing of semiconductor wafers.

Another object of the present invention is to provide a slurry delivery system which may be programmed to deliver selected quantities of slurry to a chemical mechanical polisher.

Yet another object of the present invention is to provide a slurry delivery system which may be operably connected to a chemical mechanical polisher in pairs in order to provide a continuous supply of slurry to the chemical mechanical polisher.

SUMMARY OF THE INVENTION

In accordance with these and other objects and advantages, the present invention comprises a slurry delivery system which removes air bubbles and particles from a polishing slurry and delivers the slurry to a CMP apparatus for the chemical mechanical polishing of semiconductor wafers. The slurry delivery system of the present invention comprises a bag housing fitted with a slurry intake conduit and a slurry outlet conduit. An expandible and collapsible pump bag is provided in fluid communication with the conduits inside the bag housing, and the interior of the pump bag is sealed from the bag housing. As an air/vacuum controller withdraws air from the housing, the pump bag enlarges due to the negative pressure in the housing, and slurry is drawn into the pump bag through the slurry intake conduit. As the air/vacuum controller subsequently introduces air into the housing, the pump bag collapses and the slurry is expelled from the pump bag through the slurry outlet conduit. A purge valve is provided upstream of the pump bag to remove air bubbles from the slurry and vent the air to the atmosphere. A filter is provided typically in the slurry intake conduit to filter particles from the slurry before entry into the pump bag.

A pair of the slurry delivery systems of the present invention may be connected to the chemical mechanical polisher in parallel with each other, in order to provide a continuous supply of the polishing slurry to the CMP apparatus. Accordingly, as the first system undergoes the suction phase to draw slurry from the intake conduit into the pump bag, the second system undergoes the output phase to expel the slurry from the pump bag and outlet conduit to the CMP apparatus, and vice-versa. The systems may be programmed to deliver selected quantities of the slurry to the CMP apparatus.

The purge valve is located at a higher level than and upstream of the bag housing, typically at the junction between the slurry intake conduit and the bag housing, to facilitate the destruction of air bubbles in the slurry as the air bubbles rise in the slurry from the intake conduit into the purge valve. In a preferred embodiment of the invention, the purge valve includes a rotation floater which is rotatably mounted in a purge valve housing. A spring-loaded valve ball is slidably disposed in the purge valve housing above the rotation floater. During the suction phase of the pump bag, the rotation floater engages a floater support and the valve ball engages a ball stop shoulder in the purge valve housing to prevent flow of slurry out of the slurry intake conduit and into the purge valve. During the output phase of the pump bag, the rotation floater disengages the floater support and the valve ball disengages the ball stop shoulder. Accordingly, as slurry flows into the purge valve housing and past the rotation floater, the rotation floater rotates and destroys air bubbles in the slurry. The air from the broken air bubbles rises beyond the valve stop shoulder and valve ball and is vented from the system through the vent port.

BRIEF DESCRIPTION OF THE DRAWINGS

The invention will now be described, by way of example, with reference to the accompanying drawings, in which.

DESCRIPTION OF THE PREFERRED EMBODIMENTS

The present invention has particularly beneficial utility in removing air bubbles and particles from a polishing slurry and delivering the slurry to a chemical mechanical polishing (CMP) apparatus used in the polishing of semiconductor wafers. However, the invention is not so limited in application and while references may be made to such polishing slurry and CMP apparatus, the invention is more generally applicable to removing air bubbles and particles from liquids and transporting the liquids in a variety of industrial and mechanical applications.

Figure 1:
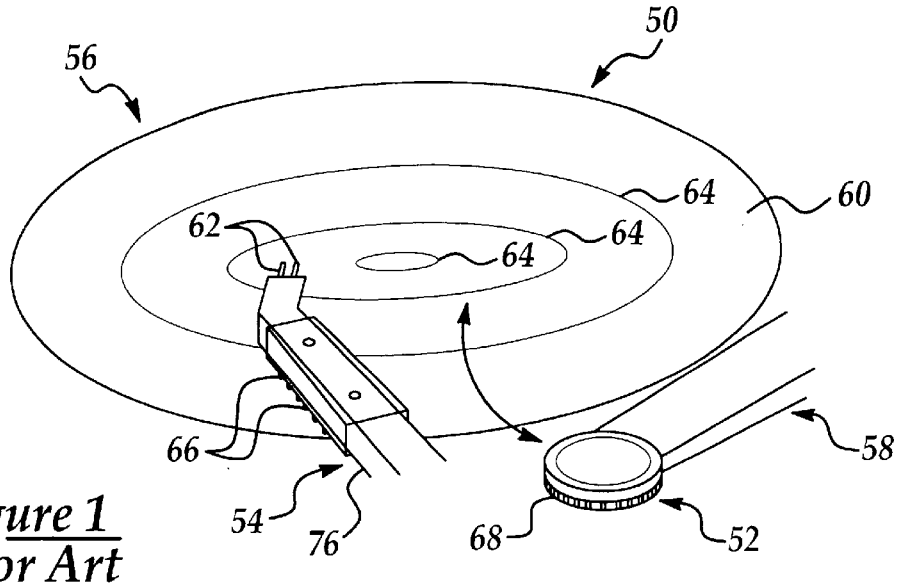
Figure 1 Prior Art
FIG. 1 illustrates a typical conventional chemical mechanical polishing (CMP) apparatus.
Figure 2:
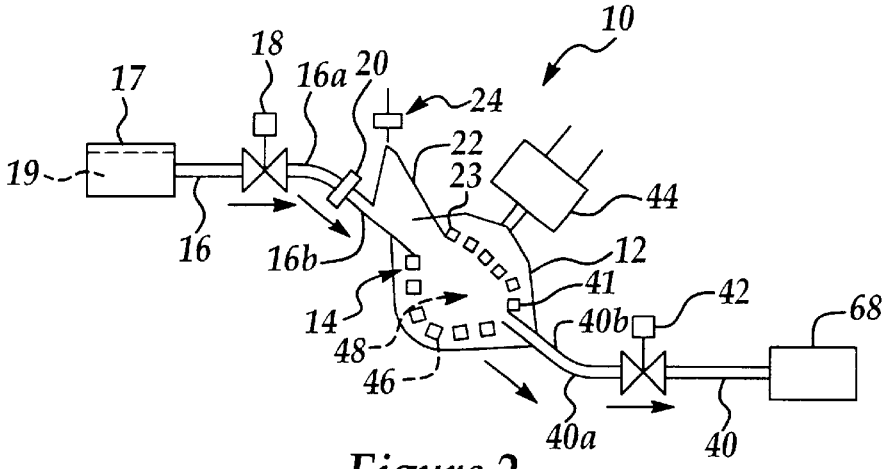
FIG. 2 is a schematic view of a slurry delivery system of the present invention, with the pump bag of the system shown in the suction phase of operation.
Figure 3:
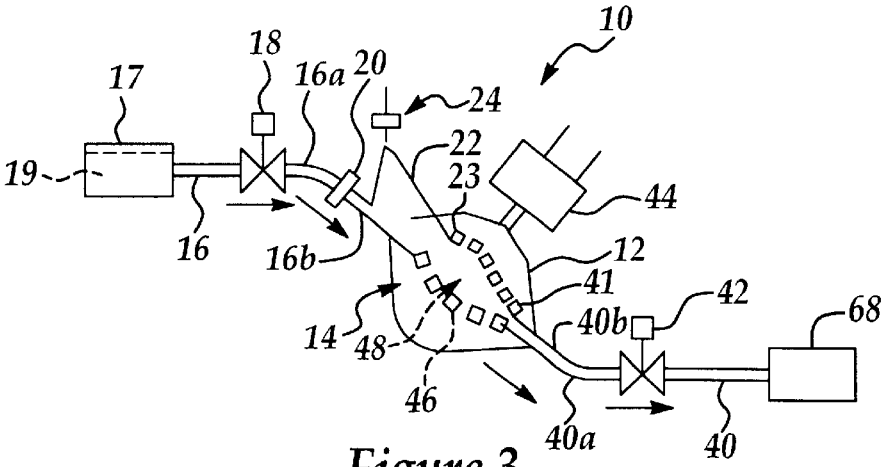
FIG. 3 is a schematic view of the slurry delivery system of the present invention, with the pump bag of the system shown in the output phase of operation.

Referring initially to FIGS. 2 and 3, an illustrative embodiment of the slurry delivery system of the present invention is generally indicated by reference numeral 10. The slurry delivery system 10 is designed to remove particulate impurities and air bubbles from a polishing slurry as it pumps the slurry from a slurry supply reservoir 17 to a CMP apparatus 68. The slurry delivery system 10 includes a slurry intake conduit 16 which leads from the slurry supply reservoir 17. A downward bend 16*a* in the slurry intake conduit 16 defines a sloped segment 16*b* of the slurry intake conduit 16. A particle filter 20 of selected design and pore size is provided in the slurry intake conduit 16, typically in the sloped segment 16*b*. An intake check valve 18 is provided in the slurry intake conduit 16, typically between the slurry supply reservoir 17 and the bend 16*a*. The sloped segment 16b of the slurry intake conduit 16 enlarges to define a purge housing 22, which extends into the upper end of a sloped bag housing 12 and includes a discharge end 23 that terminates in the housing interior 14 of the bag housing 12. A purge valve 24, the details of which will be hereinafter further described, is confluently connected to the upper end of the purge housing 22.

The sloped segment 40*b* of a slurry outlet conduit 40 angles downwardly and exits from the lower end of the sloped bag housing 12, with the intake end 41 of the slurry outlet conduit 40 extending into the housing interior 14 of the bag housing 12. The sloped segment 40*b* of the slurry outlet conduit 40 angles at a bend 40*a* to define the remaining straight segment of the slurry outlet conduit 40, which is confluent with the slurry dispensing arm (not illustrated) of the CMP apparatus 68, according to the knowledge of those skilled in the art. An output check valve 42 is provided in the slurry outlet conduit 40.

A resilient pump bag 46, which may be constructed from a Teflon sheet, includes an upper open end which is connected in gastight communication to the discharge end 23 of the purge housing 22, inside the housing interior 14. The opposite, lower open end of the pump bag 46 is, in like manner, connected in gas-tight communication to the intake end 41 of the slurry outlet conduit 40, inside the housing interior 14. Accordingly, the junctions between the pump bag 46 and the discharge end 23 of the purge housing 22 and between the pump bag 46 and the intake end 41 of the slurry outlet conduit 40 provide a gas-tight seal between the bag interior 48 of the pump bag 46 and the housing interior 14 of the bag housing 12. An air/vacuum controller 44 is confluently connected to the housing interior 14 of the bag housing 12 for alternately introducing air into the housing interior 14 and withdrawing air from the housing interior 14. Because the bag housing 12 forms a gas-tight seal with the purge housing 22 and with the sloped segment 40*b* of the slurry outlet conduit 40, the air introduced into the housing interior 14 by operation of the air/vacuum controller 44 is incapable of escaping from the housing interior 14 except back through the air/vacuum controller 44. The air/vacuum controller 44 may be actuated through a tool PC (not shown) for the CMP apparatus 68 or a system PC (not shown).

Figure 4:
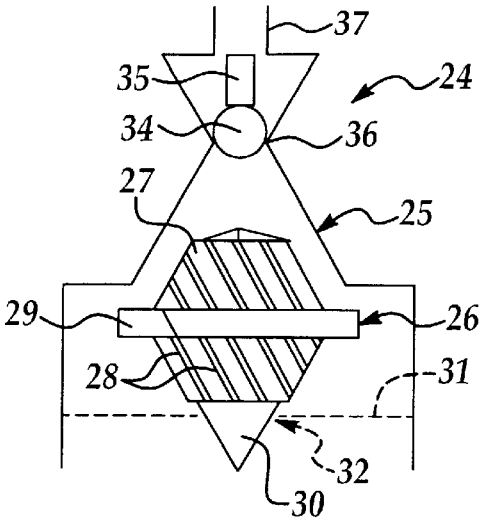
FIG. 4 is a schematic view of the purge valve element of the slurry delivery system of the present invention, with the rotation floater and valve ball components in the closed positions during the suction phase of the pump bag.
Figure 5:
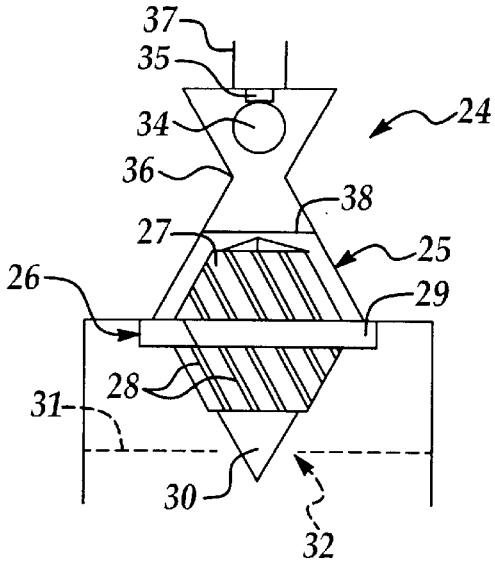
FIG. 5 is a schematic view of the purge valve element of the slurry delivery system of the present invention, with the rotation floater and valve ball components in the open positions during the output phase of the pump bag.
Figure 6:
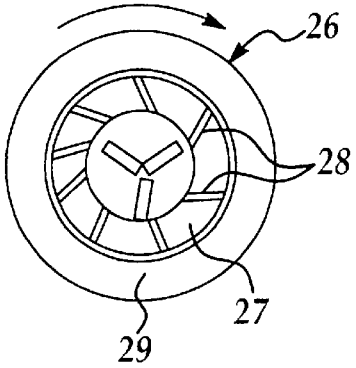
FIG. 6 is a top view of the rotation floater of the purge valve.

Referring next to FIGS. 4 and 5, the purge valve 24 includes a valve housing 25 which is confluently attached to the upper end of the purge housing 22 (FIGS. 2 and 3). A rotational floater 26, which may be constructed of Teflon, is vertically displaceably mounted in the valve housing 25. The rotational floater 26 includes a floater body 27 from which extend multiple floater vanes 28. The floater vanes 28 extend from the floater body 27 at an angle, typically toward a counterclockwise direction when the rotational floater 26 is viewed from above, as shown in FIG. 6. Alternatively, the floater vanes 28 may extend from the floater body 27 at an angle in a clockwise direction when the rotational floater 26 is viewed from above. A circumferential floater seal 29 extends from the floater body 27, and a tapered or cone-shaped floater base 30 extends downwardly from the floater body 27. The floater base 30 extends through a flow opening 32 which extends through the center of a floater support 31 that spans the interior of the valve housing 25. Accordingly, the rotational floater 26 is capable of movement between a lower position in which the floater seal 29 disengages the valve housing 25 and the floater base 30 is seated in the flow opening 32, as shown in FIG. 4, and an upper position in which the floater seal 29 engages the valve housing 25 and the floater base 30 withdraws from the flow opening 32, as shown in FIG. 5. When the rotational floater 26 is positioned in the lower configuration of FIG. 4, a spring 35 biases a valve ball 34 against a ball stop shoulder 36 above the rotational floater 26 and blocks flow of air or liquid from the valve housing 25 through a vent port 37 in the upper end of the valve housing 25. When the rotational floater 26 is positioned in the upper configuration of FIG. 5, the valve ball 34 is pushed against the spring 35 and disengages the ball stop shoulder 36 to facilitate flow of air from the valve housing 25 through the vent port 37, as hereinafter further described.

In operation of the slurry delivery system 10, and referring again to FIGS. 2 and 3, a supply of polishing slurry 19 is pumped from the slurry supply reservoir 17 to the CMP apparatus 68 and simultaneously, particles and air bubbles are removed from the slurry 19 before the slurry 19 reaches the CMP apparatus 68. Accordingly, with the intake check valve 18 in the open configuration and the output check valve 42 in the closed configuration, the pump bag 46 is initially operated in a suction phase, illustrated in FIG. 2, to draw slurry 19 from the slurry supply reservoir 17 into the bag interior 48 of the pump bag 46. This is accomplished by causing the air/vacuum controller 44 to withdraw air from the housing interior 14 of the bag housing 12. The resulting negative air pressure in the housing interior 14 (typically about −1 psi) causes the pump bag 46 to expand therein, such that slurry 19 is drawn from the slurry supply reservoir 17, through the slurry intake conduit 16, the open intake check valve 18 and particle filter 20, and into the purge housing 22 and bag interior 48, respectively. Simultaneously, the purge valve 24 assumes the closed configuration of FIG. 4, wherein the floater seal 29 of the rotational floater 26 disengages the valve housing 25 and the floater base 30 is inserted in the flow opening 32, and the valve ball 34, under actuation by the spring 35, is biased against the ball stop shoulder 36 to prevent fluids or air from exiting the purge valve 24 through the vent port 37. The particle filter 20 removes from the slurry 19 particles exceeding a selected size depending on the pore size of the particle filter 20.

After the suction phase is completed, the pump bag 46 is operated in an output phase, shown in FIG. 3, to expel the slurry from the bag interior 48, through the slurry output conduit 40 and open output check valve 42 and ultimately, to the CMP apparatus 68. Accordingly, with the intake check valve 18 in the closed configuration and the output check valve 42 in the open configuration, the air/vacuum controller 44 is operated to inject air into the housing interior 14 until the air pressure in the housing interior 14 reaches a pressure of typically about 1 psi. The air in the housing interior 14 compresses or collapses the pump bag 46, which expels the slurry 19 from the bag interior 48, through the slurry outlet conduit 40 and open output check valve 42 and ultimately, to the CMP apparatus 68.

As the pump bag 46 begins the output phase, any air bubbles (not shown) in the slurry 19 are forced upwardly through the slurry 19 in the bag interior 48 and purge housing 22. Some of the slurry 19 flows upwardly into the valve housing 25, first through the flow opening 32 and then between the floater seal 29 and valve housing 25. This upward flow of the slurry 19 causes the rotational floater 26 to rotate in the clockwise direction when viewed from the top, as shown in FIG. 6, as the flowing slurry 19 impinges on the floater vanes 28. The rotating action of the rotational floater 26 causes the floater vanes 28 to rupture and destroy any air bubbles rising through the slurry 19. The slurry 19 typically rises to the top of the rotational floater 26 in the valve housing 25, as indicated by the slurry level 38 in FIG. 5, at which time the rotational floater 26 rises in the slurry and engages the valve housing 25. Air in the valve housing 25, including air released from the ruptured air bubbles, impinges on the valve ball 34 due to the upward pressure of the air imparted by the contracting pump bag 46. Accordingly, the air flows beyond the ball stop shoulder 36 and escapes the valve housing 25 through the vent port 37. When the pump bag 46 subsequently begins a second suction phase and enlarges due to the negative pressure induced in the housing interior 14, the rotational floater 26 and valve ball 34 again assume the closed positions of FIG. 4 as the slurry 19 is drawn from the valve housing 25 and into the bag interior 48 due to the negative pressure generated in the bag interior 48.

The quantity of slurry 19 drawn into the bag interior 48 from the slurry supply reservoir 17, and thus, pumped to the CMP apparatus 68 may be varied by controlling the expansion volume of the pump bag 46 during the suction phase thereof. This is, in turn, determined by the volume of air withdrawn from the housing interior 14 by operation of the air/vacuum controller 44. The lower the pressure induced in the housing interior 14 by operation of the air/vacuum controller 44, the larger the expansion volume of the pump bag 46 and the larger the quantity of slurry 19 drawn into the bag interior 48 for subsequent pumping to the CMP apparatus 68. Conversely, the higher the pressure induced in the housing interior 14 by operation of the air/vacuum controller 44, the smaller the expansion volume of the pump bag 46 and the smaller the quantity of slurry drawn into the bag interior 48.

Figure 7:
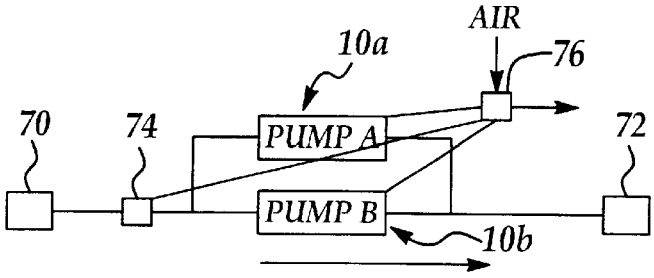
FIG. 7 illustrates utilization of a pair of slurry delivery systems of the present invention in parallel with each other to provide a continuous flow of slurry to a CMP apparatus (not shown)
Figure 8:
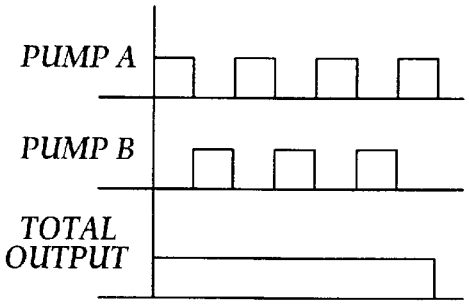
FIG. 8 is a graph illustrating staggered or alternate operation of a pair of slurry delivery systems to provide a continuous flow of slurry to a CMP apparatus.

Referring next to FIGS. 7 and 8, in typical application two slurry delivery systems, indicated by reference numerals 10*a* and 10*b*, respectively, are connected to each other in parallel as illustrated in FIG. 7. Accordingly, a pump controller 76 operates the air/vacuum controller 44, the intake check valve 18 and the output check valve 42 (FIGS. 2 and 3) components of each slurry delivery system 10*a* and 10*b* in conjunction with a shuttle valve 74 to alternately shuttle flow of slurry through the system 10*a* and system 10*b* (designated "pump A" and "pump B", respectively, in FIG. 8). Such alternating operation of the systems 10*a* and 10*b* provides a continuous flow or output of particle and air bubble free slurry 19 from a slurry supply reservoir 70 to a CMP apparatus 72, as indicated by the graph in FIG. 8.

Figure 9:
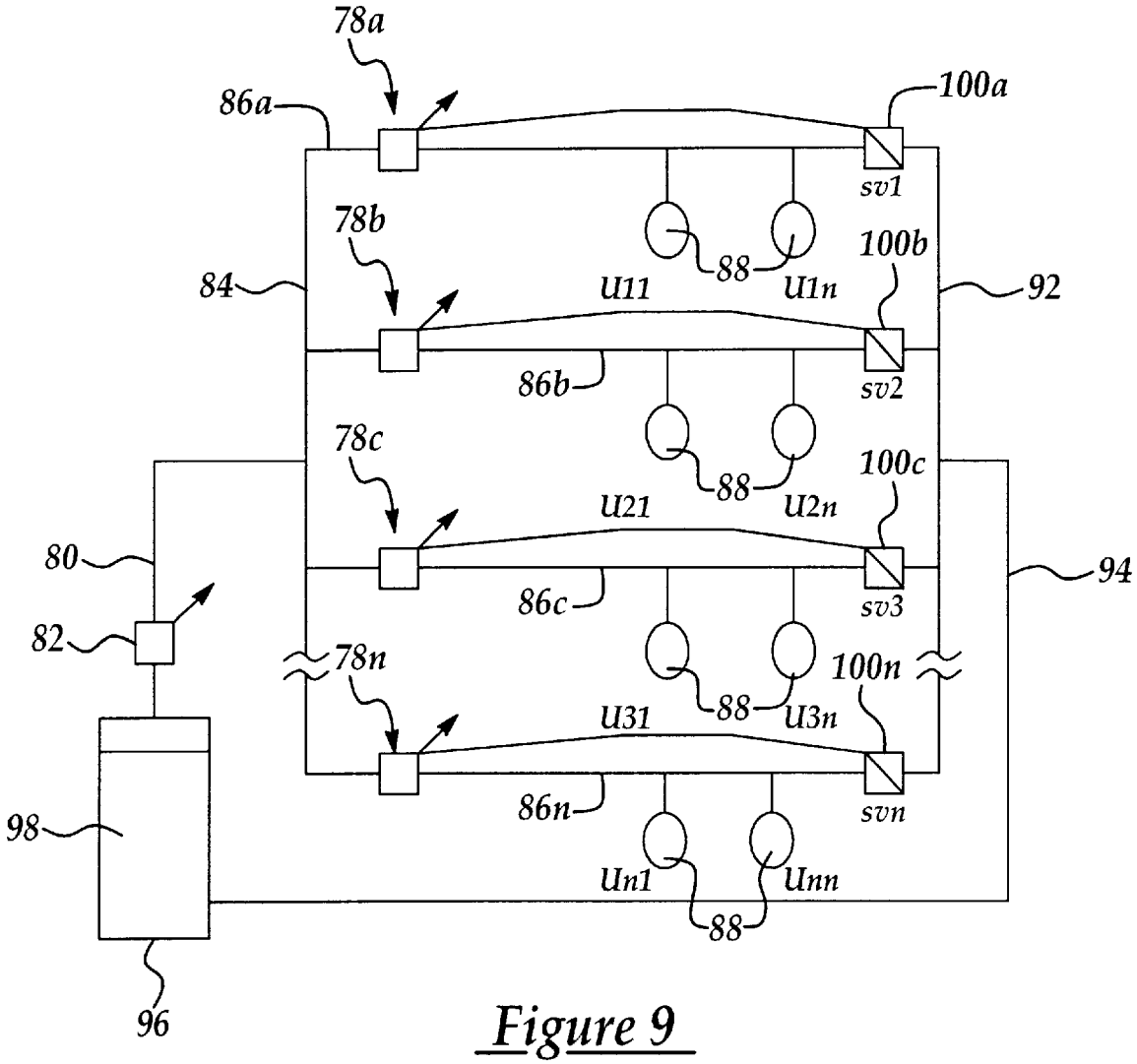
FIG. 9 is a schematic illustrating a piping configuration for multiple slurry delivery systems connected to each other in parallel.

FIG. 9 schematically illustrates a piping configuration for a selected number (n) of multiple slurry delivery systems connected to each other in parallel. Three of the slurry delivery systems 78 are designated by the reference numerals 78*a*, 78*b* and 78*c*, respectively, and the nth slurry delivery system 78 is designated by the reference numeral 78*n*. The slurry delivery systems 78 are connected through a slurry intake conduit 80, slurry intake valve 82, service conduit 84 and respective branch conduits 86 to a slurry supply reservoir 96 which contains a supply of polishing slurry 98. Each of the slurry delivery systems 78 is operated in conjunction with the slurry intake valve 82 by a central controller (not illustrated). An auto stop valve 100 is provided in each branch conduit 86, between the corresponding slurry delivery system 78 and a slurry output line 92. Typically, each pair of branch conduits 86 serviced by adjacent slurry delivery systems 78 is connected to the same CMP apparatus (not shown), which continuously receives some of the slurry 98 by alternate operation of the paired slurry delivery systems 78. Each of the branch conduits 86 is further connected to a slurry output conduit 92 which distributes the remaining slurry 98 back to the slurry supply reservoir 96 through a slurry return conduit 94. One or multiple operator positions 88 may be provided for each system 78. An auto stop valve 100 is typically included in each branch conduit 86 for automatically terminating flow of the slurry 98 through a branch conduit 86 in the event of a leakage or blockage in the branch conduit 86. For example, in the event of a blockage or leakage in the branch conduit 86*a*, the auto stop valve 100*a* terminates flow of the slurry 98 through the branch conduit 86*a* to continue supply of the slurry 98 to the slurry delivery systems 78*a*, 78*b*, 78*c* and 78*n*, respectively. Typically at least about 10% of the total volume of the slurry 98 is continuously distributed back to the slurry supply reservoir 96 in order to prevent crystallization of the slurry 98 during circulation.

While the preferred embodiments of the invention have been described above, it will be recognized and understood that various modifications can be made in the invention and the appended claims are intended to cover all such modifications which may fall within the spirit and scope of the invention.

What is claimed is:

1. A slurry delivery system for transporting a liquid from a liquid reservoir to an apparatus, said slurry delivery system comprising:

a bag housing having a housing interior;

an intake conduit connected to said bag housing for fluid communication with the liquid reservoir;

an outlet conduit connected to said bag housing for fluid communication with the apparatus;

a pump bag contained in said housing interior in fluid communication with said intake conduit and said outlet conduit;

an intake valve provided in said intake conduit;

an output valve provided in said outlet conduit; and an air/vacuum controller provided in fluid communication with said housing interior for alternately withdrawing air from said housing interior and introducing air into said housing interior to expand and compress, respectively, said pump bag.

2. The system of claim 1 further comprising a particle filter provided in said intake conduit for filtering particles from the liquid.

3. The system of claim 1 further comprising a purge valve provided in fluid communication with said intake conduit for purging air bubbles from the liquid.

4. The system of claim 3 further comprising a particle filter provided in said intake conduit for filtering particles from the liquid.

5. The system of claim 3 wherein said purge valve comprises a purge valve housing provided in fluid communication with said intake conduit, a vent port provided in said purge valve housing, a rotational floater having a plurality of floater vanes rotatably mounted in said purge valve housing between said intake conduit and said vent port, and a valve ball displaceably mounted in said purge valve housing for reversibly closing said vent port.

6. The system of claim 5 further comprising a particle filter provided in said intake conduit for filtering particles from the liquid.

7. The system of claim 5 wherein said bag housing is disposed in a downwardly-sloped configuration from said intake conduit to said outlet conduit.

8. The system of claim 7 further comprising a particle filter provided in said intake conduit for filtering particles from the liquid.

9. The system of claim 1 wherein said bag housing is disposed in a downwardly-sloped configuration from said intake conduit to said outlet conduit.

10. The system of claim 9 further comprising a particle filter provided in said intake conduit for filtering particles from the liquid.

11. The system of claim 9 further comprising a purge valve provided in fluid communication with said intake conduit for purging air bubbles from the liquid.

12. The system of claim 11 further comprising a particle filter provided in said intake conduit for filtering particles from the liquid.

13. A slurry delivery system for transporting a slurry from a liquid reservoir to an apparatus, said liquid delivery system comprising:

a bag housing having a housing interior;

an intake conduit connected to said bag housing for confluent attachment to the liquid reservoir;

a purge housing provided in fluid communication with said intake conduit;

a purge valve provided in fluid communication with said purge housing for purging air bubbles from the liquid;

an outlet conduit connected to said bag housing for fluid communication with the apparatus;

a pump bag contained in said housing interior and provided in fluid communication with said intake conduit and said outlet conduit;

an intake valve provided in said intake conduit;

an output valve provided in said outlet conduit; and an air/vacuum controller provided in fluid communication with said housing interior for alternately withdrawing air from said housing interior and introducing air into said housing interior to expand and compress, respectively, said pump bag.

14. The system of claim 13 further comprising a particle filter provided in said intake conduit for filtering particles from the liquid.

15. The system of claim 13 wherein said bag housing is disposed in a downwardly-sloped configuration from said intake conduit to said outlet conduit.

16. The system of claim 15 further comprising a particle filter provided in said intake conduit for filtering particles from the liquid.

17. A slurry delivery system for transporting a liquid from a liquid reservoir to an apparatus, said slurry delivery system comprising:

a bag housing having a housing interior;

an intake conduit connected to said bag housing for confluent attachment to the liquid reservoir;

a purge housing provided in fluid communication with said intake conduit;

a purge valve provided in fluid communication with said purge housing for purging air bubbles from the liquid, said purge valve comprising a purge valve housing provided in fluid communication with said intake conduit, a vent port provided in said purge valve housing, a rotational floater having a plurality of floater vanes rotatably mounted in said purge valve housing between said intake conduit and said vent port, and a valve ball displaceably mounted in said purge valve housing for reversibly closing said vent port;

an outlet conduit connected to said bag housing for fluid communication with the apparatus;

a pump bag contained in said housing interior and provided in fluid communication with said intake conduit and said outlet conduit;

an intake valve provided in said intake conduit;

an output valve provided in said outlet conduit; and an air/vacuum controller provided in fluid communication with said housing interior for alternately withdrawing air from said housing interior and introducing air into said housing interior to expand and compress, respectively, said pump bag.

18. The system of claim 17 further comprising a particle filter provided in said intake conduit for filtering particles from the liquid.

19. The system of claim 17 wherein said bag housing is disposed in a downwardly-sloped configuration from said intake conduit to said outlet conduit.

20. The system of claim 19 further comprising a particle filter provided in said intake conduit for filtering particles from the liquid.

* * * * *